US009956700B2

(12) United States Patent
Carey et al.

(10) Patent No.: US 9,956,700 B2
(45) Date of Patent: May 1, 2018

(54) CRAFTING TOOL

(71) Applicant: American Crafts, L.C., Orem, UT (US)

(72) Inventors: Tavnir J. Carey, West Jordan, UT (US); Andrew Hiller, Farmington, UT (US); Steven Bouck, Farmington, UT (US)

(73) Assignee: American Crafts, L.C., Lindon, UT (US)

( * ) Notice: Subject to any disclaimer, the term of this patent is extended or adjusted under 35 U.S.C. 154(b) by 94 days.

(21) Appl. No.: 14/659,475

(22) Filed: Mar. 16, 2015

(65) Prior Publication Data

US 2016/0121502 A1 May 5, 2016

Related U.S. Application Data

(60) Provisional application No. 61/928,356, filed on Jan. 16, 2014.

(51) Int. Cl.

| | |
|---|---|
| ***B26D 5/10*** | (2006.01) |
| ***B05C 1/08*** | (2006.01) |
| ***B26D 5/14*** | (2006.01) |
| ***B26F 1/42*** | (2006.01) |
| ***B44B 5/00*** | (2006.01) |

(52) U.S. Cl.

CPC ..... *B26D 5/10* (2013.01); *B05C 1/08* (2013.01); *B26D 5/14* (2013.01); *B26F 1/42* (2013.01); *B44B 5/0052* (2013.01); *B44B 5/0085* (2013.01)

(58) Field of Classification Search

CPC .... B26D 5/10; B26D 5/14; B05C 1/08; B44B 5/0052; B44B 5/0085; B26F 1/42

See application file for complete search history.

(56) References Cited

U.S. PATENT DOCUMENTS

| | | | |
|---|---|---|---|
| 2,310,262 | A | 2/1943 | Shields |
| 3,162,077 | A | 12/1964 | Brummer |

(Continued)

OTHER PUBLICATIONS

International Search Report and Written Opinion of the International Searching Authority from corresponding Application No. PCT/US15/20825 received from The International Searching Authority dated Jul. 24, 2015.

*Primary Examiner* — David Banh

(74) *Attorney, Agent, or Firm* — Durham Jones & Pinegar, P.C.

(57) ABSTRACT

A portable crafting tool, which may be readily transported from one location to another and placed on a tabletop or another suitable surface for use, and which includes rollers for applying pressure to a craft assembly, is disclosed. The craft assembly may include a platform with a tool, such as a cutting die, an embossing tool and/or a letterpress tool, a sheet of a medium (e.g., paper, vellum, acetate, foil, etc.) that is to be modified (as pressure is applied to the craft assembly) and a mat or a cover for positioning over the sheet of medium and the tool. The portable crafting tool may include a gap spacer, which adjusts a distance that the rollers are spaced apart from one another. The portable crafting tool may be configured for selective operation with a manually operated handle or with a motor that may be used in place of the handle. The portable crafting tool may be configured to engage a surface when it is deployed on the surface.

21 Claims, 4 Drawing Sheets

(56) References Cited

U.S. PATENT DOCUMENTS

| | | | | |
|---|---|---|---|---|
| 3,199,390 | A | 8/1965 | Arnould et al. | |
| 3,720,126 | A * | 3/1973 | Kranz | B31B 1/00 83/344 |
| 3,776,014 | A | 12/1973 | Artz et al. | |
| 4,112,127 | A | 9/1978 | Popeil | |
| 5,067,338 | A * | 11/1991 | Wilchynski | B21D 19/043 30/500 |
| 5,083,488 | A * | 1/1992 | Stanley | B26D 7/2628 100/168 |
| 5,388,490 | A | 2/1995 | Buck | |
| 6,533,154 | B2 | 3/2003 | Kitai et al. | |
| 6,675,855 | B1 * | 1/2004 | Lemens | B32B 37/226 156/555 |
| 7,066,192 | B1 | 6/2006 | Delaney et al. | |
| 7,117,996 | B1 * | 10/2006 | Mobley | A23N 15/00 209/667 |
| 7,546,800 | B2 * | 6/2009 | Caron | B26F 1/42 101/16 |
| 8,393,266 | B2 | 3/2013 | Rasmussen et al. | |
| 2005/0268761 | A1 | 12/2005 | Corcoran et al. | |
| 2007/0006750 | A1 * | 1/2007 | Westby | B41F 5/20 101/216 |
| 2007/0214972 | A1 * | 9/2007 | Ayala | B26F 1/42 100/176 |
| 2008/0264286 | A1 * | 10/2008 | Westby | B41F 5/20 101/483 |
| 2014/0283697 | A1 | 9/2014 | Lu et al. | |

* cited by examiner

CRAFTING TOOL

CROSS-REFERENCE TO RELATED APPLICATION

A claim for the benefit to the Jan. 16, 2014 filing date of U.S. Provisional Patent Application No. 61/928,356, titled ADJUSTABLE EMBOSSING TOOL ("the '356 Application"), is hereby made pursuant to 35 U.S.C. § 119(e). The entire disclosure of the '356 Application is hereby incorporated by reference.

TECHNICAL FIELD

This disclosure relates generally to crafting tools that comprise presses with rollers that are configured to apply pressure to assemblies that are introduced between the rollers and to die cut, letterpress indicia onto and/or emboss sheets of media (e.g., paper, etc.) of the assemblies. More specifically, this disclosure relates to portable crafting tools that are configured to be used on tabletops or other elevated surfaces. This disclosure relates even more specifically to portable crafting tools with rollers that may be selectively positioned a plurality of distances apart from one another, to portable crafting tools that enable a user to select between hand-operation and motorized operation and to portable crafting tools that are configured to engage a surface when they are deployed on the surface.

SUMMARY

A portable crafting tool is configured to be readily transported from one location to another and placed on a tabletop or another suitable surface for use. The portable crafting tool includes rollers for applying pressure to a craft assembly, which may include a platform with a tool, such as a cutting die, an embossing tool and/or a letterpress tool, a sheet of a medium (e.g., paper, vellum, acetate, foil, etc.) that is to be modified (as pressure is applied to the craft assembly) and a mat or a cover for positioning over the sheet of medium and the tool. The rollers may be accessed when the trays of the portable crafting tool are deployed, and inaccessible when the trays are stowed, or folded against a housing of the portable crafting tool, to facilitate transportation and/or storage of the portable crafting tool.

In one aspect, a portable crafting tool may include a gap spacer, which I configured to adjust a distance that the rollers of the crafting tool are spaced apart from one another. The gap spacer may include a dial which may provide a desired gap, or spacing between the rollers, by manual rotation. Indicia may be associated with the dial to provide a user with a visual indication of the size of the gap, or the distance that rollers are spaced apart from one another, and, thus, of the types of craft assemblies with which such a gap may be used.

In another aspect, a portable crafting tool may be configured to enable a user to select between manual operation and motorized operation. Such a portable crafting tool may include a handle that is configured to be removably coupled to a crank shaft, as well as a motor that may be removably coupled to the crank shaft. The handle may include a locking element with an unlocked position that enables the handle to be placed on and removed from the crank shaft, and a locked position that secures the handle to the crank shaft. The motor may also include a locking mechanism. The locking mechanism of the motor may be configured to releasably engage a housing of the portable crafting tool in a manner that enables the motor to be securely, stably and removably retained on the housing.

According to another aspect, a portable crafting tool may be configured to engage a surface when it is deployed on the surface. More specifically, a portable crafting tool may include a plurality of feet that are operatively associated with the trays of the portable crafting tool. When the trays are stowed, the feet do not engage a surface on which they are positioned; the portable crafting tool may be readily picked up and moved or slid from one location to another. When the trays are deployed, however, the feet may engage the surface upon which they are positioned, which may secure the portable crafting tool in place upon the surface.

Other aspects, as well as features and advantages of various aspects of the disclosed subject matter, will become apparent to those of ordinary skill in the art through consideration of the ensuing description, the accompanying drawings and the appended claims.

DETAILED DESCRIPTION

Figure 1:
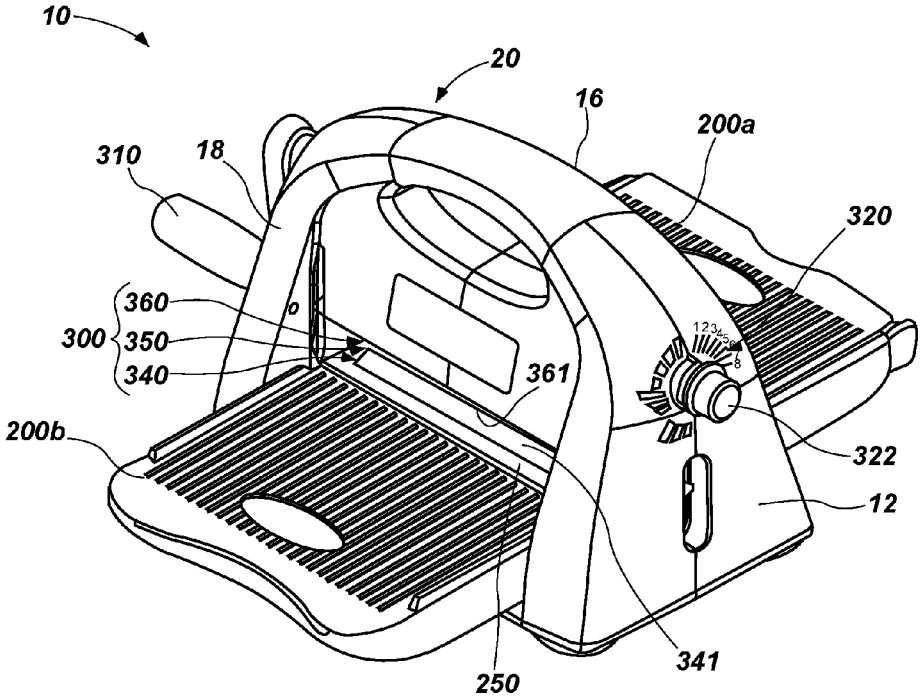
FIG. 1 provides an orthogonal view of an embodiment of a crafting tool according to this disclosure.

With reference to FIG. 1, the exterior of an embodiment of a crafting tool 10 is illustrated. The crafting tool 10, which functions as a press, is a portable device that is configured to be placed in open and closed arrangements (the open, or deployed, arrangement being shown in FIG. 1; the closed, or stowed, arrangement shown in FIGS. 2 and 3) and used on a tabletop or another elevated surface. In use, the crafting tool 10 is placed in an open arrangement, with a pair of trays 200*a* and 200*b* oriented horizontally or substantially horizontally, and a portion of its roller assembly 300 accessible at a location between the trays 200*a* and 200*b*. More specifically, a receptacle 250 between the trays 200*a* and 200*b* provides access to a receptacle 350 of the roller assembly 300, which receptacle 350 is defined by opposed surfaces 341 and 361 of rollers 340 and 360, respectively, of the roller assembly 300.

Figure 2:
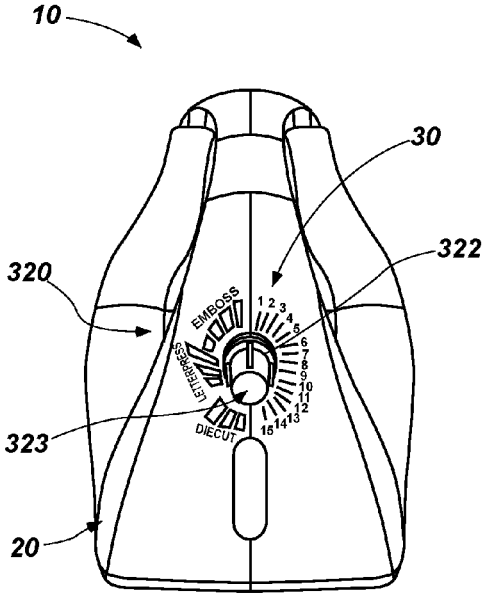
FIG. 2 shows a first end of the embodiment of crafting tool depicted by FIG. 1.
Figure 3:
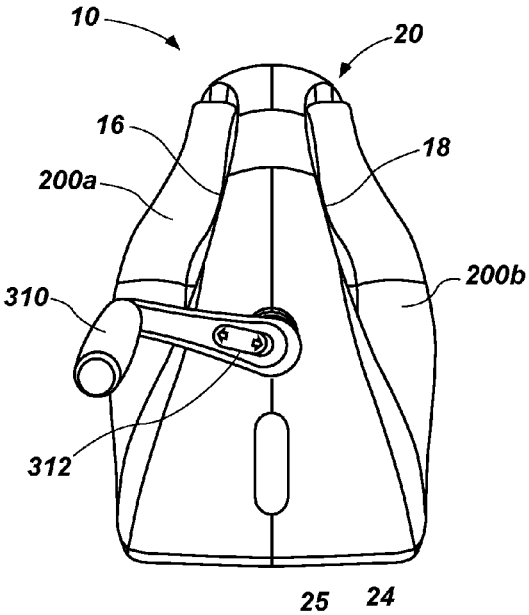
FIG. 3 illustrates a second end of the embodiment of crafting tool depicted by FIG. 1.

FIG. 1, along with FIGS. 2 and 3, also illustrates several other features that are accessible from an exterior of the crafting tool 10. For example, FIGS. 1 and 3 depict an arrangement in which a handle 310 is coupled to a crank shaft 314 (FIG. 4) of the roller assembly 300 (see also, FIG. 6). The handle 310 facilitates manual operation of the roller assembly 300. More specifically, rotation of the crank shaft 314 causes the rollers 340 and 360 to rotate in opposite directions in a manner that will be described in further detail hereinafter. By causing the rollers 340 and 360 to rotate in opposite directions, rotation of the handle 310 and the crank shaft 314 may drive a platform assembly (not shown) from one tray 200*a* on one side 16 of the crafting tool 10, through into the receptacle 250, through the receptacle 350 between the rollers 340 and 360 and out of the other sides of the receptacles 350 and 250 onto the tray 200*b* on the other side 18 of the crafting tool 10.

Figure 4:
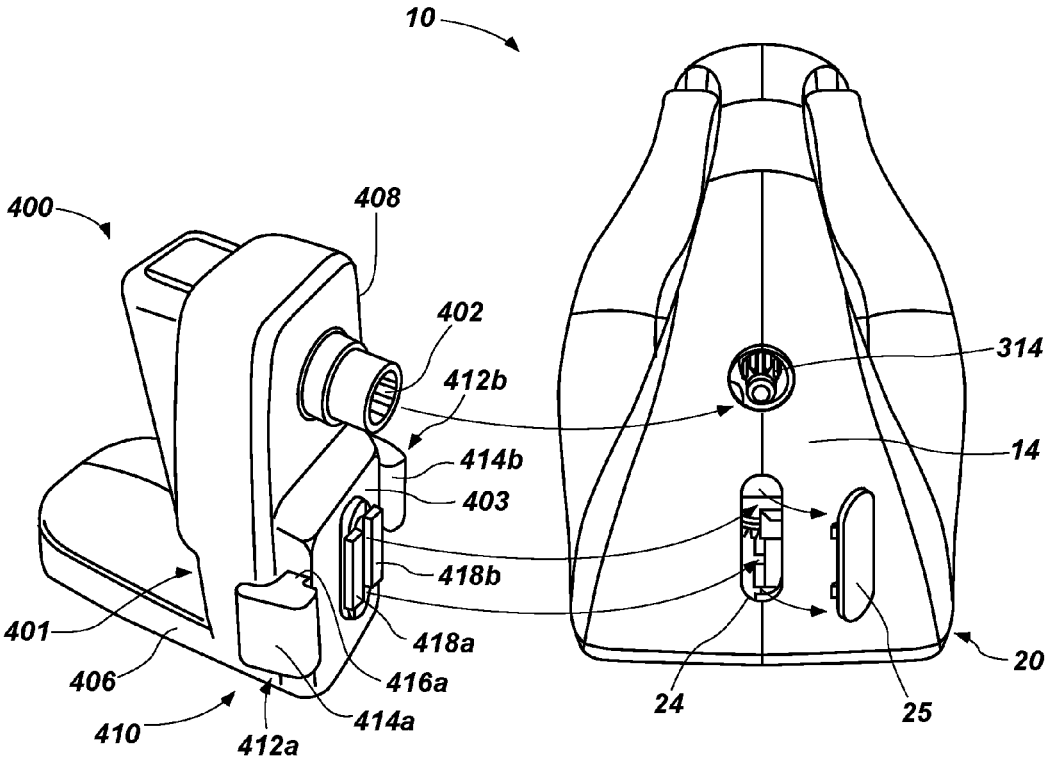
FIG. 4 depicts assembly of a motor with a crank shaft of the embodiment of crafting tool shown in FIG. 1.

As illustrated by FIG. 3, the handle 310 may include a locking mechanism 312 that enables it to be locked into place on the crank shaft 314 or removed from the crank shaft 314, which can be seen in FIG. 4. In the depicted embodiment, the locking mechanism 312 includes a switch with a first, unlocked position, and a second, locked position. In its unlocked position, the switch may enable a receptacle (not shown) of the handle 310 to be placed onto (i.e., to receive) and/or to be removed from the crank shaft 314. With the handle 310 properly positioned on the crank shaft 314, placement of the switch in its locked position may cause a feature of the locking mechanism 312 to engage a corresponding feature of the crank shaft 314, which may hold the handle 310 in place on the crank shaft 314.

Figure 5:
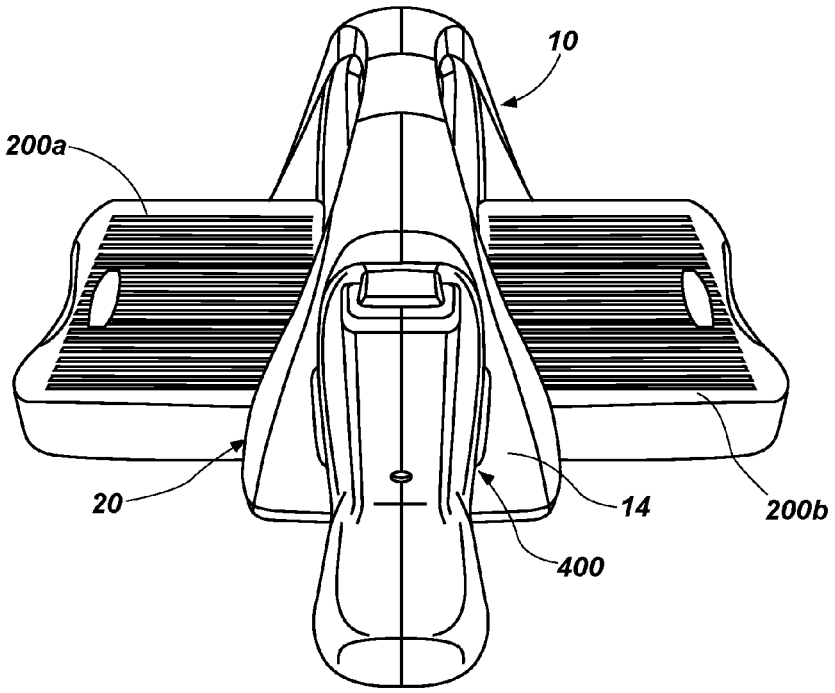
FIG. 5 shows the motor of FIG. 4 in an assembled relationship with the crafting tool shown in FIG. 4.

As an option to the use of a handle 310 to enable manual operation of the roller assembly 300 (FIGS. 1 and 6), as illustrated by FIGS. 4 and 5, a motor 400 may be used to drive the roller assembly 300. The motor 400 may include a receptacle 402 that is configured to receive and to engage the crank shaft 314 of the roller assembly 300. The motor 400 may also include a locking mechanism 410. The locking mechanism 410 of the motor 400 may be configured to secure the motor 400 stably to the crafting tool 10 and, in some embodiments, may enable the motor 400 to securely remain in place on the crafting tool 10 while the crafting tool 10 is being stored and/or while the crafting tool 10 is being transported from one location to another. Since the motor 400 is relatively large, the locking mechanism 410 of the motor 400 may be configured to secure the motor 400 to a housing 20 of the crafting tool 10.

In the embodiment illustrated by FIGS. 4 and 5, the locking mechanism 410 of the motor 400 includes a pair of locking elements 412*a* and 412*b*, which are located on opposite sides 406 and 408, respectively, of the motor 400. Each locking element 412*a*, 412*b* includes an actuator 414*a*, 414*b* an intermediate element 416*a*, 416*b* and a locking feature 418*a*, 418*b*. The actuators 414*a* and 414*b* may be located on opposite sides of the motor 400 and, when they are pressed toward one another, they, and the intermediate elements 416*a* and 416*b*, may force the locking features 418*a* and 418*b* of the locking elements 412*a* and 412*b* toward one another.

The intermediate element 416*a*, 416*b* of each locking element 412*a*, 412*b* is located between its corresponding actuator 414*a*, 414*b* and its corresponding locking feature 418*a*, 418*b*. Each intermediate element 416*a*, 416*b* may be configured to hold the locking element 412*a*, 412*b* of which it is a part in place relative to a housing 401 of the motor 400. In the depicted embodiment, each intermediate element 416*a*, 416*b* has an L-shaped structure, with a medially extending member (i.e., toward the intermediate element 416*b*, 416*a* of the other locking element 412*b*, 412*a*) adjacent to each actuator 414*a*, 414*b* and an outwardly extending member at the medial end of each medially extending member. The medially extending member of each intermediate element 416*a*, 416*b* may extend laterally into a portion of the housing 401 at its corresponding side 406, 408 of the motor 400, while the outwardly extending member of each intermediate element 416*a*, 416*b* may extend out of an end 403 of the housing 401 that is to be positioned adjacent to or against the housing 20 of the crafting tool 10 at the end 14 from which the crank shaft 314 is accessible.

The locking feature 418*a*, 418*b* of each locking element 412*a*, 412*b* is configured to engage a corresponding feature of the crafting tool 10. In the embodiment depicted by FIGS. 4 and 5, the locking features 418*a* and 418*b* are configured to engage opposite side edges of a slot 24 (which is illustrated as an oblong, vertically oriented slot) in a portion of the housing 20 that defines the end 14 of the crafting tool 10. More specifically, each illustrated locking feature 418*a*, 418*b* comprises a member that extends laterally from the end of the outwardly extending member of the corresponding intermediate element 416*a*, 416*b* (i.e., away from the locking feature 418*b*, 418*a* of the other locking element 412*b*, 412*a*). The distance that each locking feature 418*a*, 418*b* is spaced from the housing 401 of the motor 400 may be about the same as or slightly larger than the thickness of the edge of the slot 24 in the housing 20 of the crafting tool 10 that the locking feature 418*a*, 418*b* is configured to engage.

In addition to the locking elements 412*a* and 412*b*, the locking mechanism 410 of the motor 400 may include one or more springs (not shown) that resiliently bias the locking elements 412*a* and 412*b* away from one another. Thus, when the actuators 414*a* and 414*b* of the locking elements 412*a* and 412*b* are pressed toward one another, energy may be stored in the spring(s). After the actuators 414*a* and 414*b* have been pressed toward one another to force the locking features 418*a* and 418*b* toward or against each other, and the locking features 418*a* and 418*b* have been inserted into a corresponding slot 24 in the housing 20 of the crafting tool 10, the actuators 414*a* and 414*b* may be released. Upon releasing the actuators 414*a* and 414*b*, the energy stored by the spring(s) may be released, causing the spring to expand and to resiliently bias the intermediate elements 416*a* and 416*b* of the locking elements 412*a* and 412*b* apart from one another, which may also cause the locking features 418*a* and 418*b* of the locking elements 412*a* and 412*b* to engage opposite edges of the slot 24 and return the actuators 414*a* and 414*b* to their initial, un-depressed positions.

In the embodiment of crafting tool 10 illustrated by FIGS. 3 and 4, the slot 24 that is configured to be engaged by the locking mechanism 410 of a motor 400 may be covered by a hatch 25. The hatch 25 may be included for aesthetic purposes, providing the housing 20 of the crafting tool 10 with a desired (e.g., clean, etc.) appearance (such as that shown in FIG. 3) when a motor 400 is not in place on the crafting tool 10. The hatch 25 may be removable, or it may be configured to be depressed into the housing 20 when the locking features 418*a* and 418*b* of the locking elements 412*a* and 412*b* of the locking mechanism 410 are introduced into the slot 24. In such an embodiment, one or more springs (not shown) may be positioned behind (i.e., against the interior surface of) the hatch 25, and may be configured to force the hatch 25 back into an opening of the slot 24 once the locking features 418*a* and 481*b* are removed from the slot 24. In such an embodiment, to ensure that the hatch 25 properly aligns with the slot 24 upon closing the slot, the hatch 25 may be configured to self-align as the spring(s) force(s) it back into the slot 24, or it may include features that maintain alignment between the hatch 25 and the slot 24.

Configurations of the crafting tool 10, the handle 310 and the motor 400 such as those disclosed above enable the crafting tool 10 to operate either manually in a more automated fashion. Because either a handle 310 or a motor 400 may be used to operate the crafting tool 10, a user of the crafting tool 10 may select the manner in which she wants to operate the crafting tool 10. With configurations of the handle 310 and the motor 400 including, but not limited to, those disclosed herein, a user may readily switch between a handle 310 to a motor 400, or between manual operation and motorized operation.

As another example of a feature that may be accessed from an exterior of the crafting tool 10, FIGS. 1 and 2 show a gap spacer 320 on one end 12 of the crafting tool 10. The gap spacer 320 is configured to enable adjustment of the distance between the rollers 340 and 360, or the height of the receptacle 350 between (and defined by) the rollers 340 and 360.

At the exterior of the crafting tool 10, the gap spacer 320 may comprise a dial 322, or a knob, which may be configured to be twisted by hand. The dial 322 may include a pointer 323, which may correspond to indicia 30 on the housing 20 of the crafting tool 10. The indicia 30 may correspond to various distances that the rollers 340 and 360 may be spaced apart from one another, or the size of a gap, or of the receptacle 350, between the rollers 340 and 360. In a specific embodiment, the indicia 30 may represent types of assemblies that may be introduced into and through the receptacle 250 of the crafting tool 10, with each type of assembly having a different thickness from other types of assemblies. Optionally, each indicium 30 may comprise a number that corresponds to one or more particular types of assemblies from specific manufacturers. Without limitation, such an assembly may comprise a die cutting assembly (representing the smallest gap sizes), a letterpress assembly (representing intermediate gap sizes), an embossing assembly (representing wider gap sizes) or the like. Of course, each indicium 30 corresponds to a certain distance; accordingly, the indicia 30 may identify actual distances.

In some embodiments, the gap spacer 320 may be configured to provide for discrete intervals between gap sizes. The dial 322 of such an embodiment of gap spacer 320 may be configured to rotate when it is depressed and to be locked into rotational position (i.e., prevented from rotating) when the dial 322 is released. A specific embodiment of such a gap spacer 320 may include a spring-loaded dial 322 and two sets of annularly arranged teeth that are configured to engage each other.

Figure 6:
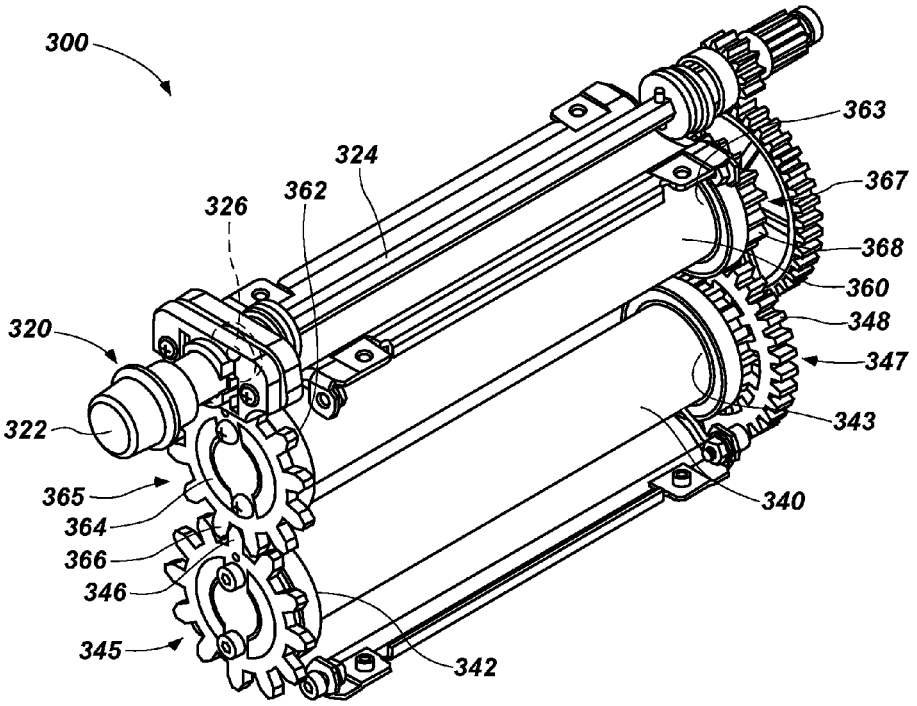
FIG. 6 provides an orthogonal view of an embodiment of roller assembly, which includes a gap spacer, of the embodiment of crafting tool depicted by FIG. 1.
Figure 7:
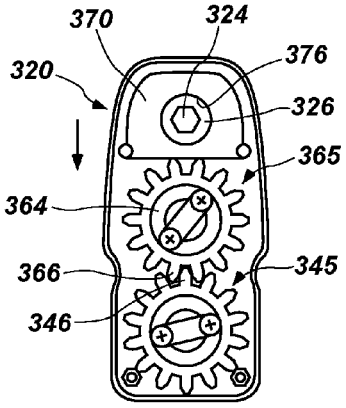
FIGS. 7, 7A and 7B illustrate an embodiment of a system of gears on one side of the roller assembly shown in FIG. 6, with FIGS. 7, 7A and 7B showing the axes of rotation of the gears being positioned different distances apart from each other by the gap spacer.

Referring now to FIGS. 6 and 7, the dial 322 of the gap spacer 320 may be secured to a shaft 324. Thus, when the dial 322 is rotated, the shaft 324 also rotates. The axes of rotation of the dial 322 and the shaft 324 are fixed relative to the housing 20 (FIGS. 1 and 2) of the crafting tool 10 (FIGS. 1 and 2) and relative to a main frame 302 of the roller assembly 300. Accordingly, despite their rotational orientations, the dial 322 and the shaft 324 always remain in the same or substantially the same locations relative to the main frame 302 and the housing 20 of the crafting tool 10.

In addition to the dial 322 and the shaft 324, the gap spacer 320 includes at least one drive wheel 326 on the shaft 324; the depicted embodiment of gap spacer 320 includes two drive wheels 326, with one drive wheel 326 being located near each end of the shaft 324. Each drive wheel 326 is associated with the shaft 324 in such a way that when the shaft 324 rotates, each drive wheel 326 on the shaft 324 also rotates. As illustrated by FIG. 7, each drive wheel 326 is circular in shape. The location at which the shaft 324 extends through the drive wheel 326 is offset from the center of the drive wheel 326 (i.e., it is a non-central location). Thus, when the shaft 324 rotates about its axis (e.g., by turning the dial 322), each drive wheel 326 rotates eccentrically relative to the shaft 324.

Figure 7A:
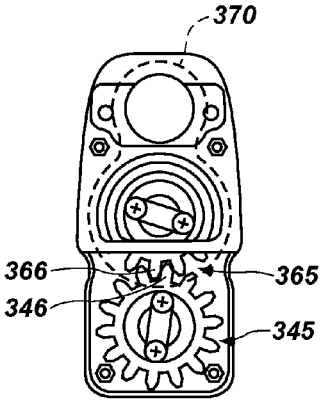
Figure 7B:
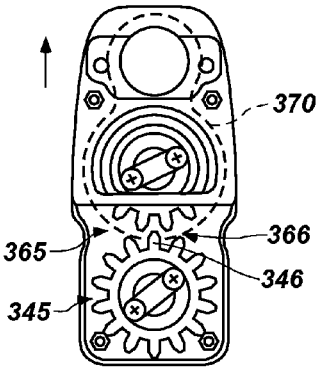

Each drive wheel 326 of the gap spacer 320 is associated with a carriage 370 for one of the rollers 360—the top roller in the depicted embodiment. The carriage 370, which may include an element located at at least one end of the roller 360, may define the axis of rotation of the roller 360. More specifically, a shaft 364 about which the roller 360 rotates may extend through an aperture through the carriage 370. Moreover, the roller 360 moves with the carriage 370; thus, when the carriage 370 is lifted, the roller 360 also moves up; when the carriage 370 is lowered, the roller 360 also moves down. The carriage 370 includes a circular aperture 376 within which the drive wheel 326 resides, and within which the drive wheel 326 may rotate. An inner diameter of the circular aperture 376 is about the same as or slightly larger than an outer diameter of a portion of the drive wheel 326 that resides against the edges of the circular aperture 376. Because the axis of rotation of the shaft 324 is fixed relative to the main frame 302 of the roller assembly 300, because the drive wheel 326 rotates eccentrically relative to the shaft 324, and since the drive wheel 326 and the circular aperture 376 are similar in size, rotation of the shaft 324 causes the carriage 370 to move up and/or down. The rotational position of the shaft 324 (and, thus, of the dial 322 at the end of the shaft 324) determine an elevation of the carriage 370 relative to the main frame 302. FIGS. 7, 7A and 7B depict three different elevations of the carriage 370 relative to the main frame 302, each depending upon the rotational positions of the shaft 324 and the drive wheel 326. In FIG. 7, the gap between the rollers 340 (FIG. 6) and 360 (FIG. 6) is smallest, while FIG. 7B represents the largest gap between the rollers 340 and 360. Since the roller 360 moves with the carriage 370, the rotational positions of the drive wheel 326, the shaft 324 and the dial 320 also determine the distance that the roller 360 associated with the carriage 370 is spaced apart from the other roller 340 of the roller assembly, thereby enabling the pointer 323 on the dial 322 and the corresponding indicia 30 (FIGS. 1 and 2) on the housing 20 (FIGS. 1 and 2) of the crafting tool 10 (FIGS. 1 and 2) to provide an accurate indication of the spacing between the rollers 340 and 360.

In addition to the gap spacer 320, the roller assembly 300 of the crafting tool 10 (FIGS. 1 and 2) may include gears 345 and 365 and/or gears 347 and 367 that accommodate the differential spacing between the rollers 340 and 360 while enabling the rollers 340 and 360 to be driven together and at the same rotational speeds as one another regardless of the distance that the gap spacer 320 has spaced the rollers 340 and 360 apart from one another. In the depicted embodiment, the gears 345 and 365 are located at first ends 342 and 362 of their respective rollers 340 and 360, while the gears 347 and 367 are located at second ends 343 and 363 of their respective rollers 340 and 360. As depicted by FIGS. 7, 7A and 7B, each gear 345, 365 includes teeth 346, 366, respectively, that have lengths and shapes that enable them to mesh with one another when the centers, or axes of rotation, of the gears 345 and 365 are positioned a variety of different distances apart from each other. Likewise, the teeth 348 of gear 347 (FIG. 6) and the teeth 368 of gear 367 (FIG. 6) may be configured to mesh with one another when the gap spacer 320 positions the centers, or axes of rotation, of gears 347 and 367 a variety of different distances apart from one another. Thus, when one of the rollers 340 rotates, the gear(s) 345, 347 associated with that roller 340 will engage the corresponding gear(s) 365, 367 of the other roller 360 in a manner that causes the other roller 360 to rotate in the opposite direction, but at the same speed as roller 340 rotates.

Figure 8:
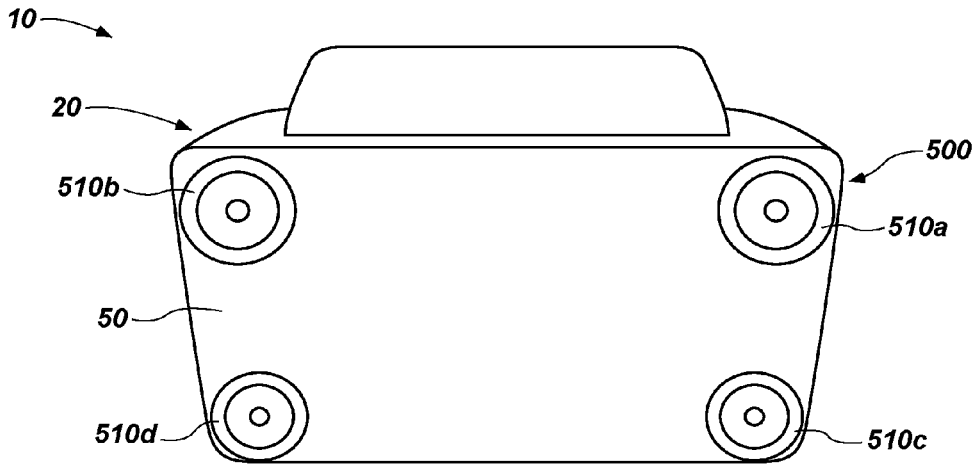
FIG. 8 illustrates a base of a housing of the embodiment of crafting tool depicted by FIG. 1, showing feet at the base of the housing.
Figure 9:
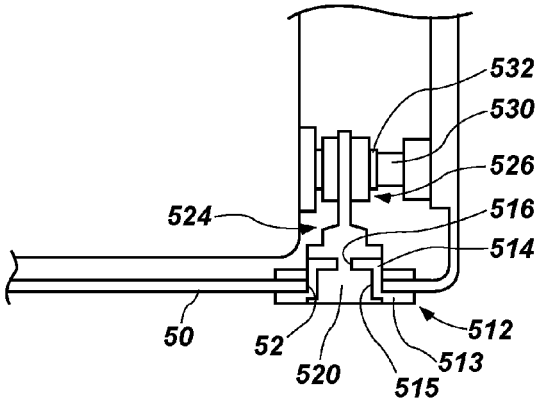
FIGS. 9 and 10 illustrate internal components of the feet shown in FIG. 8, as well as the manner in which the feet operate when trays of the crafting tool are moved between open and closed positions.
Figure 10:
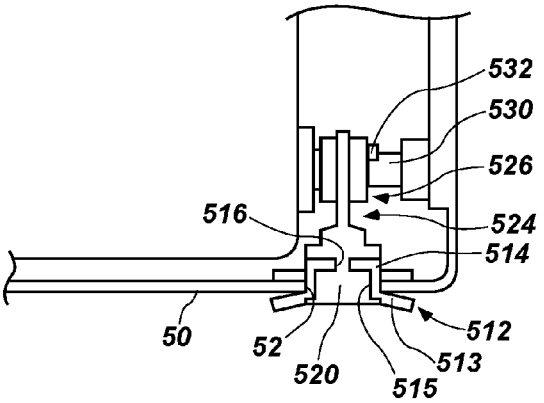

Turning now to FIGS. 8 through 10, and with continued reference to FIG. 1, an embodiment of a securing system 500, which may be configured to automatically secure a crafting tool 10 according to this disclosure to a surface on which the crafting tool 10 is to be used, is illustrated. As shown in FIGS. 1 and 8, the crafting tool 10 may be deployed by positioning feet 510*a*, 510*b*, 510*c*, 510*d* (each of which may also be referred to herein as a "foot 510," and which may be collectively referred to as "feet 510") on a base 50 of the housing 20 of the crafting tool 10 against a surface, such as a tabletop. With the feet 510 in place on the surface, one or both of the trays 200*a*, 200*b* may be unfolded from the housing 20 of the crafting tool 10. As each tray 200*a*, 200*b* is unfolded, a pair of feet 510 that correspond to that tray 200*a*, 200*b* (e.g., feet 510*a* and 510*b* may correspond to tray 200*a*, while feet 510*c* and 510*d* may correspond to tray 200*b*) engage the surface.

As FIGS. 8 through 10 show, each foot 510 includes a suction member 512 located on the base 50 of the housing 20 of the crafting tool 10. The suction member 512 of each foot 510 may comprise a compressible, resilient material, such as a rubber (e.g., a silicone rubber, a neoprene rubber, etc.) that may be deformed, return to its original shape and, when a pulling force is applied to the suction member 512, seal against a surface on which it is placed. In the depicted embodiment, the suction member 512 of each foot 510 has a hat-shaped configuration, with an annular base 513 and a crown 514 that protrudes from an inner periphery of the annular base 513. The annular base 513 of the suction member 512 of each foot 510 is configured to be positioned against the base 50, around an aperture 52 through the base 50. The crown 514 may have dimensions that are substantially the same as or slightly smaller than corresponding dimensions of the aperture 52, and may be configured to be received by the aperture 52. The suction member 512 of each foot 510 may also include a recess 515 through the annular base 512 and in the crown 514, as well as an aperture 516 through a top of the crown 514.

In addition to the suction member 512, each foot 510 may include a rigid base 520 that is configured to reside within recess 515 of the suction member 512 and to be pulled into, and to pull the crown 514 of the suction member 512 into, its corresponding aperture 52 in the base 50 of the housing 20 of the crafting tool 10. When the rigid base 520 of a foot 510 is in an un-deployed position, as shown in FIG. 9, a bottom surface of the rigid base 520 may be substantially coplanar with a bottom surface of its corresponding suction member 512. As the rigid base 520 is deployed, as illustrated by FIG. 10, it is pulled into the aperture 52 through the base 50 of the housing 20, which pulls the crown 514 of the suction member 512 into aperture 52 through the base 50 of the housing 20, and creates suction between the annular base 513 of the suction member 512. The suction between the annular base 513 of the suction member 512 and the surface against which the annular base 513 has been placed may secure the suction member 512, the base 50 of the housing 20 and, thus, the crafting tool 10 to the surface.

Movement of the rigid base 520 of each foot 510 between the un-deployed position (shown in FIG. 9) and the deployed position (illustrated by FIG. 10) may occur as an actuator 524 of the foot 510 moves the rigid base 520 up (from the un-deployed position to the deployed position) or down (from the deployed position to the un-deployed position). The actuator 524 of each foot 510 may be secured to a corresponding rigid base 520 through the aperture 516 that extends through top part of the crown 514 of the suction member 512 of that foot 510 (e.g., by way of a screw, etc.). The manner in which the actuator 524 and the rigid element 520 are secured to one another may ensure that, as the actuator 524 moves up and down, the rigid element 520 also moves up and down.

The actuator 524 of each foot 510 may include an aperture 526 (e.g., an aperture with an elliptical cross-sectional shape, an aperture with an oval cross-sectional shape, an aperture with an oblong shape having rounded edges, etc.) that receives a hinge 530 about which a tray 200*a*, 200*b* (FIG. 1) of the crafting tool 10 pivots. More specifically, an eccentric element 532 on a portion of the hinge 530 may extend through the aperture 526 of the actuator 524 to cause the actuator 524 to move down when the tray 200*a*, 200*b* is placed in a closed position against the housing 20 of the crafting tool 10 and to cause the actuator 524 to move up when the tray 200*a*, 200*b* is placed in an open, or a deployed, position, in which the tray 200*a*, 200*b* is oriented horizontally or substantially horizontally. With the tray(s) 200*a*, 200*b* in the closed position, little or no suction will exist between the feet 510 and the surface on which they rest, enabling the crafting tool 10 to be readily removed from the surface. When one or both of the trays 200*a*, 200*b* are deployed, however, sufficient suction will exist between the feet 510 and the surface on which the feet 510 rest to secure the crafting tool 10 in place upon the surface.

In use, a crafting tool 10 such as that depicted in FIGS. 2 and 3, which has been stored and transported in a stowed arrangement, may be positioned on a surface, such as a tabletop, where it will be used. Once the crafting tool 10 is in place on the surface, and has been positioned in a desired manner, its trays 200*a* and 200*b* may be opened, or deployed, and locked into place relative to the housing 20 of the crafting tool 10, as illustrated by FIG. 1. When the trays 200*a* and 200*b* are opened, or deployed, the feet 510 shown in FIGS. 8 through 10 may engage the surface on which the crafting tool 10 has been positioned (e.g., by suction, etc.), which may secure the crafting tool 10 to the surface.

Figure 11:
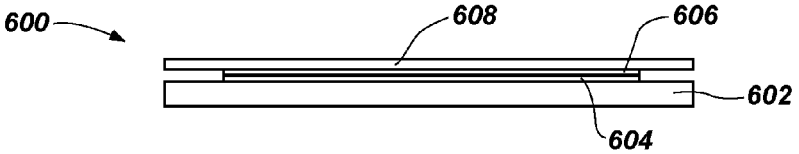
FIG. 11 depicts use of the crafting tool to modify (e.g., cut, print onto and/or emboss, etc.) a sheet of media, such as paper.

With the crafting tool 10 in position on the surface and the trays 200*a* and 200*b* deployed, the crafting tool 10 may be used to apply pressure to assemblies of media, such as paper, with cutting dies, letterpress components and/or embossing tools (e.g., folders, etc.). As illustrated by FIG. 11, a craft assembly 600 that includes a platform 602, one or more tools 604 (e.g., cutting dies, embossing tools, letterpress tools, combination tools, etc.), a sheet of media 606 (e.g., paper, vellum, an acetate film, a foil, etc.) and a mat 608 or cover may be placed on one tray 200*a* of the crafting tool 10 shown in FIG. 1, and an end of the craft assembly 600 may be introduced into the receptacles 250 and 350. The gap spacer 320 may then be adjusted by moving the dial 322 to a position appropriate for a type or thickness of the craft assembly 600.

With the rollers 340 and 360 of the crafting tool 10 positioned an appropriate distance apart from one another, the roller assembly 300 may then be operated manually (e.g., by rotating the handle 310 shown in FIG. 3) or with a motor 400 (e.g., that shown in FIG. 5). Operation of the roller assembly 300 drives the craft assembly 600 (FIG. 11) between the rollers 340 and 360, which applies pressure to the craft assembly 600 and enables the craft assembly 600 to modify the sheet of media 606 in a desired manner.

Once use of the crafting tool 10 is complete, the trays 200*a* and 200*b* may be moved from their deployed positions, shown in FIG. 1, to their folded, closed or stowed positions, shown in FIGS. 2 and 3. Upon closing the trays 200*a* and 200*b*, the feet 510, which are shown in FIGS. 8 through 10, disengage the surface on which the crafting tool 10 rests, enabling removal of the crafting tool 10 from the surface, as well as its transportation to another location and/or its storage.

Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

What is claimed:

1. A portable crafting tool, comprising:

a housing;

a roller system carried at least partially within the housing, the roller system including:

a pair of rollers, including a first roller and a second roller, that are spaced apart from one other by way of a gap, the first roller being configured to rotate in a first direction and the second roller being configured to rotate in a second direction, the second direction being opposite from the first direction, the first roller and the second roller configured to rotate at the same rate as one another;

a movable carriage to which the first roller and an axis of rotation of the first roller are fixed, the movable carriage comprising a drive aperture that is circular in shape;

a drive wheel residing within the circular aperture of the movable carriage, the drive wheel being circular and having a diameter that is the same as or slightly smaller than a diameter of the circular aperture; and a shaft having an axis of rotation that remains fixed relative to a position of the housing, the shaft being associated with the drive wheel in such a way as to rotate the drive wheel eccentrically as the shaft rotates, eccentric rotation of the drive wheel being configured to cause the movable carriage to move and to cause the first roller to move toward and away from the second roller to respectively decrease and increase a distance across the gap; and a dial accessible from an exterior of the housing, the dial configured to rotate the shaft and the drive wheel and to move the movable carriage and a position of the first roller relative to a position of the second roller;

a handle;

a motor;

a crank shaft capable of being rotated to cause the first roller and the second roller to rotate, the crank shaft capable of separately and releasably receiving:

the handle for manual rotation of the crank shaft; and the motor for motorized rotation of the crank shaft.

2. The portable crafting tool of claim 1, further comprising:

inidicia on the housing, the indicia configured, along with the dial, to provide an indicator of a distance across the gap between the first roller and the second roller.

3. The portable crafting tool of claim 2, wherein the indicia provide an indicator of a type of assembly that may be introduced between and pressed by the first roller and the second roller based on the distance across the gap.

4. The portable crafting tool of claim 1, wherein the movable carriage carries a first gear secured at or near an end of the first roller in such a way that the first gear rotates with the first roller, the roller system further including a second gear secured at or near an end of the second roller in such a way that the second gear rotates with the second roller, teeth of the first gear and teeth of the second gear being meshed with each other, the teeth of the first gear and the teeth of the second gear being configured to mesh with each other while axes of rotation of the first gear and the second gear are spaced a plurality of different distances apart from each other.

5. The portable crafting tool of claim 1, further comprising:

a pair of trays on opposite sides of the housing, a first tray of the pair of trays configured to enable a craft assembly to be introduced into the gap between the pair of rollers, a second tray of the pair of trays configured to receive the craft assembly from the gap between the pair of rollers.

6. The portable crafting tool of claim 5, wherein each tray of the first tray and the second tray has a stowed position, in which the tray is positioned against a side of the housing, and a deployed position, in which the tray is positioned horizontally to provide access to the gap between the first roller and the second roller.

7. The portable crafting tool of claim 6, wherein each tray of the pair of trays is operably associated with a pair of feet, each foot of the pair of feet being configured to engage a surface upon which the foot is positioned when the tray is placed in the deployed position and to disengage the surface upon which the foot is positioned when the tray is placed in the stowed position.

8. The portable crafting tool of claim 7, wherein the foot and the tray are configured to generate suction against the surface when the tray is placed in the deployed position and to release the suction when the tray is placed in the stowed position.

9. The portable crafting tool of claim 1, wherein the handle includes a locking mechanism, the locking mechanism being configured to retain the handle in place on the crank shaft.

10. The portable crafting tool of claim 9, wherein the locking mechanism of the handle comprises a switch including a locked position and an unlocked position, the locked position configured to retain the handle in place on the crank shaft, the unlocked position configured to enable the handle to be coupled to the crank shaft and uncoupled from the crank shaft.

11. The portable crafting tool of claim 1, wherein the motor includes a locking mechanism.

12. The portable crafting tool of claim 11, wherein the locking mechanism of the motor is configured to releasably engage the housing and, when coupled with the housing, to securely and stably hold the motor on the housing.

13. The portable crafting tool of claim 12, wherein:

the housing includes a slot with a depressible hatch; and the locking mechanism includes a pair of locking features that are configured to be forced together, introduced into the slot and biased apart from one another to engage edges of the slot.

14. A portable crafting tool, comprising:

a housing;

a roller system carried at least partially within the housing, the roller system including:

a pair of rollers, including a first roller and a second roller, that are spaced apart from one other by way of a gap, the first roller being configured to rotate in a first direction and the second roller being configured to rotate in a second direction, the second direction being opposite from the first direction, the first roller and the second roller configured to rotate at the same rate as one another; and a crank shaft for causing the first roller and the second roller to rotate;

a handle capable of enabling manual rotation of the crank shaft; and a motor capable of enabling motorized rotation of the crank shaft, each of the handle and the motor capable of being individually and releasably coupled to the crank shaft in a manner that facilitates rotation of the crank shaft.

15. The portable crafting tool of claim 14, wherein the handle includes a locking mechanism, the locking mechanism being configured to retain the handle in place on the crank shaft.

16. The portable crafting tool of claim 15, wherein the locking mechanism of the handle comprises a switch including a locked position and an unlocked position, the locked position configured to retain the handle in place on the crank shaft, the unlocked position configured to enable the handle to be coupled to the crank shaft and uncoupled from the crank shaft.

17. The portable crafting tool of claim 14, wherein the motor includes a locking mechanism.

18. The portable crafting tool of claim 17, wherein the locking mechanism of the motor is configured to releasably engage the housing and, when coupled with the housing, the securely and stably hold the motor on the housing.

19. The portable crafting tool of claim 18, wherein:

the housing includes a slot with a depressible hatch; and the locking mechanism includes a pair of locking features that are configured to be forced together, introduced into the slot and biased apart from one another to engage edges of the slot.

20. A portable crafting tool, comprising:

a housing including a slot;

a roller system carried at least partially within the housing, the roller system including:

a pair of rollers, including a first roller and a second roller, that are spaced apart from one other by way of a gap, the first roller being configured to rotate in a first direction and the second roller being configured to rotate in a second direction, the second direction being opposite from the first direction, the first roller and the second roller configured to rotate at the same rate as one another; and a crank shaft for causing the first roller and the second roller to rotate;

a handle capable of enabling manual rotation of the crank shaft; and a motor capable of enabling motorized rotation of the crank shaft following removal of the handle from the crank shaft, the motor including a locking mechanism with a pair of locking features that are capable of being forced together for introduction into the slot and biased apart from one another once present within the slot to secure the motor to the housing, each of the handle and the motor capable of being individually and releasably coupled to the crank shaft to facilitate rotation of the crank shaft.

21. The portable crafting tool of claim 20, wherein the housing further includes a depressible hatch capable of assuming a closed orientation when the locking features of the motor are not present within the slot and of assuming an open orientation to facilitate introduction of the locking features of the motor into the slot.

* * * * *